US009745815B2

(12) United States Patent
Dugas et al.

(10) Patent No.: US 9,745,815 B2
(45) Date of Patent: Aug. 29, 2017

(54) APPARATUS AND METHODS FOR SEALING AROUND THE OPENING TO A CELLAR FORMED AROUND A HYDROCARBON EXPLORATION OR PRODUCTION WELL

(71) Applicant: NEWPARK MATS & INTEGRATED SERVICES LLC, The Woodlands, TX (US)

(72) Inventors: Aaron William Dugas, Carencro, LA (US); Kenneth Edward Durio, Arnaudville, LA (US); James Kerwin McDowell, Lafayette, LA (US); Randy Paul Bordelon, Opelousas, LA (US); Richard Lamar Edwards, Jr., Lafayette, LA (US)

(73) Assignee: Newpark Mats & Integrated Services LLC

( * ) Notice: Subject to any disclaimer, the term of this patent is extended or adjusted under 35 U.S.C. 154(b) by 219 days.

(21) Appl. No.: 14/497,429

(22) Filed: Sep. 26, 2014

(65) Prior Publication Data

US 2015/0101831 A1 Apr. 16, 2015

Related U.S. Application Data

(60) Provisional application No. 61/889,171, filed on Oct. 10, 2013.

(51) Int. Cl.
*E21B 33/02* (2006.01)

(52) U.S. Cl.
CPC ..... *E21B 33/02* (2013.01)

(58) Field of Classification Search
CPC ..... E21B 33/02; E21B 33/03
USPC ..... 166/81.1, 82.1, 83.1, 364; 404/25, 26
See application file for complete search history.

(56) References Cited

U.S. PATENT DOCUMENTS

| | | | |
|---|---|---|---|
| 5,098,220 | A | 3/1992 | Norman |
| 5,111,879 | A | 5/1992 | Jozwiak et al. |
| 6,286,593 | B1 | 9/2001 | Holtby |
| 6,386,225 | B1 | 5/2002 | Holtby |
| 7,987,904 | B1 | 8/2011 | Rose |
| 8,127,837 | B1 | 3/2012 | Rose |
| 8,770,273 | B1 | 7/2014 | Gibson |
| 2009/0223661 | A1 | 9/2009 | Khazanovich et al. |
| 2013/0264773 | A1 | 10/2013 | McDowell |
| 2014/0102691 | A1 | 4/2014 | Gibson |
| 2014/0255108 | A1 | 9/2014 | McDowell |

*Primary Examiner* — Robert E Fuller
*Assistant Examiner* — Steven MacDonald
(74) *Attorney, Agent, or Firm* — E. Randall Smith; E. Randall Smith, P.C.

(57) ABSTRACT

Apparatus useful for providing a liquid-tight seal around a cellar formed around a hydrocarbon exploration or production well includes a clamp and at least one platform. The clamp is configured to engage a wall extending around the cellar and the platform is configured to extend outwardly from the clamp over the earth's surface adjacent to the cellar.

31 Claims, 8 Drawing Sheets

APPARATUS AND METHODS FOR SEALING AROUND THE OPENING TO A CELLAR FORMED AROUND A HYDROCARBON EXPLORATION OR PRODUCTION WELL

The present application claims priority to U.S. Provisional Patent Application Ser. No. 61/889,171 filed on Oct. 10, 2013 and entitled "Apparatus and Methods for Sealing Around the Opening to an Underground Borehole", which is hereby incorporated by reference herein in its entirety.

FIELD OF THE DISCLOSURE

The present disclosure relates to sealing around the opening to an underground borehole.

BACKGROUND

Underground boreholes are formed or used in various industries, such as hydrocarbon exploration and production wells. In the oilfield industry, for example, such wells are often formed with a "cellar" located at its upper end. The cellar is a dug-out area, or pit, at the top of the borehole which often has inner walls lined with wood, cement, pipe or other material. The cellar is typically wider than the borehole and may provide additional height between the rig floor and the well head. The cellar may be useful, for example, to collect drainage water and other liquids for disposal, accommodate the installation of and/or provide access to one or more wellhead components, such as a casing spool, casing head, BOP, or other purposes.

It is often desirable to provide a liquid-tight seal around the opening to an underground borehole, such as to prevent the liquids form spilling out of the borehole onto the earth or subgrade terrain adjacent to the borehole. Sometimes, temporary or semi-permanent support surfaces are used around the borehole site. These support surfaces are often made up of heavy duty, durable, all-weather thermoplastic mats, which are reusable and interlock together to form the support surface. In instances where a support surface is located proximate to an underground borehole, it may likewise be desirable to provide a liquid-tight seal at the juncture of the support surface and the underground borehole, such as to prevent the liquids disposed on the support surface or within the borehole from contacting or contaminating the earth adjacent to the underground borehole or beneath the adjacent support surface.

Traditionally, a plastic liner is placed around the borehole (and around or below adjacent mats when a support surface is used) in an effort to capture liquids overflowing from the borehole (or introduced onto the support surface) before such liquids encounter the subgrade terrain. The use of liners may have one or more disadvantages. In many instances, the liners are not reusable and must often be discarded. This can be problematic because landfill operators have expressed disinterest in accepting used liners on the basis that they are bulky and require excessive landfill space, or for other reasons. Thus, it can be difficult to find suitable, cost-effective ways to dispose of the liners. For another example, the plastic liners are sometimes ineffective at preventing liquid leakage into the subgrade terrain or allowing effective clean-up, which can cause other problems and require significant time and effort. Thus, there is a need for improved apparatus, systems and methods for preventing liquids from entering the earth adjacent to an underground wellbore.

It should be understood that the above-described features, capabilities and disadvantages are provided for illustrative purposes only and are not intended to limit the scope or subject matter of the appended claims or those of any related patent application or patent. Thus, none of the appended claims or claims of any related application or patent should be limited by the above discussion or construed to address, include or exclude each or any of the above-cited features, capabilities or disadvantages merely because of the mention thereof herein.

Accordingly, there exists a need for improved systems, articles and methods useful in connection with sealing around the opening to an underground borehole having one or more of the attributes or capabilities described or shown in, or as may be apparent from, the various portions of this patent application.

BRIEF SUMMARY OF THE DISCLOSURE

In some embodiments, the present disclosure involves apparatus useful for providing a liquid-tight seal around a cellar formed around a hydrocarbon exploration or production well. The cellar may have a wall extending around it, downwardly below the earth's surface, but not above the earth's surface. The apparatus includes a clamp shaped and configured to be positioned inside the cellar proximate to the opening thereof and to firmly engage the inside of the cellar wall around the entirety of the cellar. The clamp includes at least first and second interconnectable sections, each section having at least one inwardly projecting connection bracket. Each connection bracket of each clamp section is releasably engageable with one of the connection brackets of another clamp section to connect the clamp sections together. At least one platform is configured to extend outwardly from the clamp relative to the cellar, over the top edge of the cellar wall and across the earth's surface adjacent to and around the cellar when the clamp is engaged with the cellar wall. At least one seal member is configured to be disposed between the cellar wall and at least one among the clamp and the platform to form a liquid-tight seal therebeteween.

In various embodiments, the present disclosure involves apparatus useful for providing a liquid-tight seal around a cellar formed around a hydrocarbon exploration or production well. The cellar has at least one wall extending around it, and upwardly above and downwardly below the earth's surface. The apparatus includes a clamp configured to be positioned around the cellar wall above the earth's surface proximate to the opening of the cellar. The clamp is configured to firmly engage the outside of the cellar wall around the entirety of the cellar. The clamp includes at least first and second interconnectable sections. Each section has at least one outwardly projecting connection bracket. Each connection bracket is releasably engageable with one of the connection brackets of another clamp section to connect the clamp sections together and firmly engage the cellar wall. At least one platform is configured to extend outwardly from the clamp relative to the cellar, away from the top edge of the cellar wall and above the earth's surface adjacent to the cellar when the clamp is engaged with the cellar wall. At least one seal member is disposed between the cellar wall and at least one among the clamp and the platform to form a liquid-tight seal therebeteween.

In many embodiments, the present disclosure involves a liquid containment system useful around a cellar formed around a hydrocarbon exploration or production well and extending into the earth from the earth's surface. The cellar has an opening and a wall extending around itself. The system includes a reusable load-supporting surface deployed on or near the earth's surface proximate to the cellar. The load-supporting surface includes at least two. A clamp is configured to sealingly engage the cellar wall around the cellar proximate to the opening thereof. At least one platform is configured to extend outwardly from the clamp relative to the cellar and over the earth's surface adjacent to the cellar. At least one frame is configured to sealingly engage and extend at least partially between the platform and at least one adjacent mat of the load-supporting surface around the entire perimeter of the cellar. At least one seal member is configured to be disposed between the cellar wall and at least one among the clamp and the platform to form a liquid-tight seal therebeteween.

The present disclosure also includes embodiments of a method of providing a liquid-tight seal between a cellar formed around a hydrocarbon exploration or production well extending into the earth from the earth's surface and a reusable load-supporting surface deployed on or near the earth's surface proximate to the cellar The load-supporting surface includes at least two mats and the cellar has a wall extending around itself. The method includes sealingly engaging at least one clamp with the cellar wall around the perimeter of the cellar proximate to the opening thereof. At least one platform is extended outwardly from the clamp relative to the cellar around the perimeter of the cellar and over the earth's surface adjacent to the cellar. At least one frame is sealingly engaged to the platform and at least one adjacent mat of the load-supporting surface around the entire perimeter of the cellar.

Accordingly, the present disclosure includes features and advantages which are believed to enable it to advance cellar and borehole sealing technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
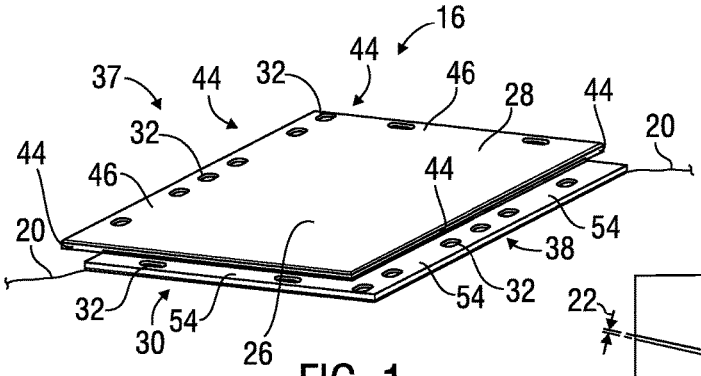
FIG. 1 is a perspective view of an exemplary mat useful in a load-supporting surface in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application or any patent or patent application claiming priority hereto. On the contrary, the intention is to cover all modifications, equivalents and alternatives falling within the spirit and scope of this disclosure or any appended claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 2:
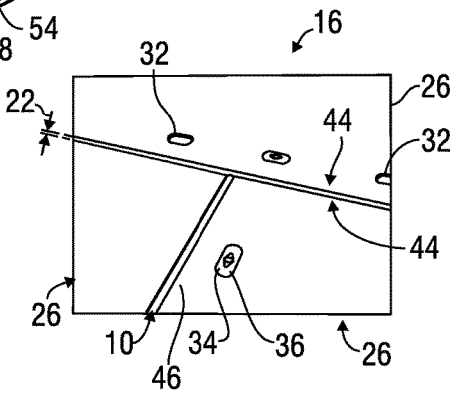
FIG. 2 is a top view of a portion of an exemplary load-supporting surface useful in accordance with an embodiment of the present disclosure.

Referring initially to FIGS. 1 and 2, an exemplary load-supporting surface 16 having at least one mat 26 deployed on or near the ground is shown. As used herein, the term "ground" and variations thereof mean the earth's surface, and/or other one or more other surfaces, structures or areas proximate to the earth's surface. In the present embodiment, the load-supporting surface 16 is reusable and capable of supporting the weight of personnel, vehicles and/or equipment thereupon. The mats 26 may have any suitable form, construction and configuration. Some examples of mats 26 which may be used in various embodiments of the present disclosure are shown and described in U.S. Pat. No. 5,653,551 to Seaux, entitled "Mat System for Construction of Roadways and Support Surfaces" and issued on Aug. 5, 1997, and U.S. Pat. No. 6,511,257 to Seaux et al., entitled "Interlocking Mat System for Construction of Load Supporting Surfaces" and issued on Jan. 28, 2003, both of which have a common Assignee as the present patent. For example, the mats 26 may be 14'×8' DURA-BASE® mats currently sold by the Assignee of this patent. If desired, the load supporting surface 16 may be used in connection with any of the components and features described and shown in U.S. patent application Ser. No. 13/790,916 filed Mar. 8, 2013 and entitled "Liquid Containment System for Use with Load-Supporting Surfaces", U.S. Provisional Patent Application Ser. No. 61/857,474, filed on Jul. 23, 2013 and entitled "Apparatus and Methods for Providing Illuminated Signals from a Support Surface", U.S. patent application Ser. No. 14/336,163 filed on Jul. 21, 2014 and entitled "Apparatus and Methods for Providing Illuminated Signals from a Support Surface", U.S. Provisional Patent Application Ser. No. 51/888,580 filed on Oct. 9, 2013 and entitled "Apparatus & Methods for Electrically Grounding a Load-Supporting Surface", U.S. patent application Ser. No. 14/496,105 filed on Sep. 25, 2014 and entitled "Apparatus & Methods for Electrically Grounding a Load-Supporting Surface" each of which has a common Assignee as the present patent and the entire contents of which are hereby incorporated by reference herein in their entireties.

Still referring to FIGS. 1 and 2, in the illustrated embodiment, each mat 26 is flat, or planar, and constructed of impermeable material, such as thermoplastic. The exemplary mat 26 has a rectangular shape with an opposing pair of short sides 28, 30, an opposing pair of long sides 37, 38, and an edge 44 extending along each side 28, 30, 37 and 38. In this particular example, the first short side 28 and first long side 37 each have an upper lip 46 extending horizontally outwardly therefrom, forming the edge 44 and which will be spaced above the ground 20 or other surface. The second short side 30 and second long side 38 each have a lower lip 54 extending horizontally outwardly therefrom below the edge 44 thereof and which will rest on the ground 20 or other surface. The upper and lower lips 46, 54 may have any suitable size, shape, configuration and length. It should be understood, however, that the borehole edge seal system 110 of the present disclosure is not limited to use with the above-described embodiments of mats 26 having upper and/or lower lips 46, 54. For example, other embodiments of the borehole edge seal system 110 may be used in connection with mats 26 not having upper and/or lower lips 46, 54.

In this embodiment, the respective upper and lower lips 46, 54 of different mats 26 are interconnectable with locking pins 34 (e.g. FIGS. 2 & 10) releasably securable through corresponding locking pin holes 32 formed therein. The locking pin holes 32 and locking pins 34 may have any suitable form, construction and configuration. The illustrated mats 26 include a plurality of locking pin holes 32, each configured to accept a releasable locking pin 34 (e.g. FIG. 2) therethrough. Each illustrated mat 26 may include a total of sixteen locking pin holes 34, eight formed in each of the upper and lower lips 46, 54. In some embodiments, the locking pins 34 may form a liquid-tight seal around, or in, the locking pin holes 32 within which they are engaged. Some examples of locking pins 34 which may be used in various embodiments of the present disclosure are shown and described in U.S. Pat. No. 6,722,831 to Rogers et al, entitled "Fastening Device" and issued on Apr. 20, 2004, U.S. Provisional Patent Application Ser. No. 61/748,818, entitled "Apparatus and Methods for Connecting Mats" and filed on Jan. 14, 2013, and U.S. patent application Ser. No. 13/780,350, entitled "Apparatus and Methods for Connecting Mats" and filed on Feb. 28, 2013, all of which have a common Assignee as the present patent and the entire contents of which are hereby incorporated by reference herein in their entireties.

In the illustrated example, the locking pin holes 32 of the mats 26 have an oval-shape to accept an oval-shaped enlarged head 36 (e.g. FIG. 2) of the illustrated locking pins 34. It should be noted, however, that the present disclosure is not limited to use with the above-described or referenced types and configurations of load-supporting surfaces 16, mats 26, locking pins 34 and locking pin holes 32, or to the disclosures of the above-referenced patents and patent applications. Any suitable load-supporting surfaces 16, mats 26, locking pins 34 and locking pin holes 32 may be used.

Still referring to FIGS. 1 and 2, in some embodiments, a gap 22 may be formed between adjacent edges 44 of adjacent interconnected mats 26 in the load-supporting surface 16 and one or more seal members 10 may be included therein. For example, the seal member(s) 10 may provide a liquid-tight seal in the gap 22 between adjacent mats 26 to prevent liquid introduced onto the load-supporting surface 16 from seeping or flowing between and below the load-supporting surface 16. Some embodiments of seal members 10 that may be used in the gaps 22 are disclosed in U.S. patent application Ser. No. 13/803,580, filed on Mar. 14, 2013 and entitled "Apparatus and Methods for Sealing Between Adjacent Components of a Load-Supporting Surface", U.S. Provisional Patent Application Ser. No. 62/013,899 filed on Jun. 18, 2014 and entitled "Load-Supporting Surface with Interconnecting Components and Top Side Seal Assembly for Sealing Therebetween and Methods of Assembly and Use Thereof", U.S. Provisional Patent Application Ser. No. 62/011,805 filed on Jun. 13, 2014 and entitled "Load-Supporting Surface with Interconnecting Components and Frame-Style Seal Assembly for Sealing Therebetween and Methods of Assembly and Use Thereof", all of which have a common Assignee as the present patent and the entire contents of which are hereby incorporated by reference herein in their entireties.

The seal member 10 may also or instead be used between one or more mats 26 and one or more other components associated with the load-supporting surface 16, and/or between the other components themselves. Some examples of such additional components that may be useful in connection with load-supporting surfaces 16, such as berm members, spacers, drive-over barriers, liquid drain assemblies, etc., are shown and disclosed in U.S. patent application Ser. No. 13/790,916, entitled "Liquid Containment System for Use With Load-Supporting Surfaces" and filed on Mar. 8, 2013.

Figure 3:
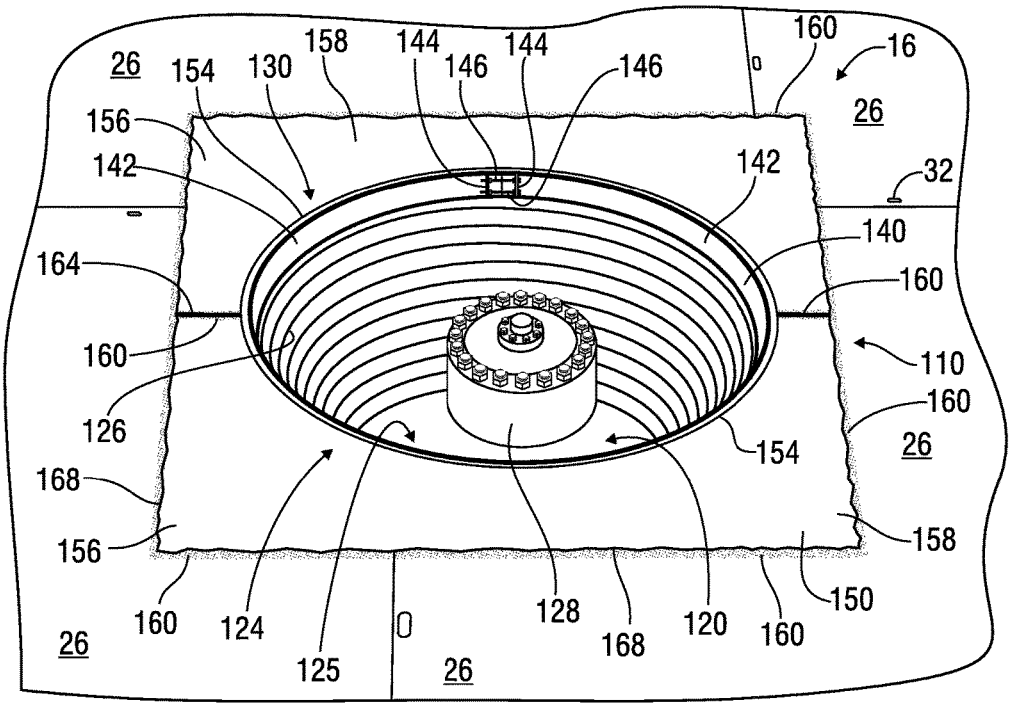
FIG. 3 is a perspective view of a borehole equipped with an embodiment of a borehole edge seal system having an inside-clamp arrangement in accordance with the present disclosure.

Referring now to FIG. 3, in accordance with the present disclosure, an embodiment of a borehole edge seal system 110 is shown used in connection with a load-supporting surface 16 around an underground borehole 120. This particular borehole 120 is a hydrocarbon well 124 with a wide section, or cellar, 125 at its upper end. The exemplary borehole 120 has an opening 130 (at the upper end of the cellar 125) that is accessible from the earth's surface. However, the borehole edge seal system 110 of the present disclosure is not limited to use with hydrocarbon wells, but may be used with any underground hole accessible from the ground. Thus, as used herein, the terms "borehole" and variations thereof mean any hole or orifice in the earth that is accessible from an opening in the surface of the earth or other area or structure. In the detailed description herein, the term "borehole" includes, or refers to, the "cellar" located at the upper end of the borehole as referenced above. In other words, the detailed description herein is written from the perspective that a "cellar" is a form of, or may be the upper part of, a borehole.

This particular borehole 120 (e.g. well 124 with cellar 125) includes a wellhead 128 accessible through the cellar 125 and a wall 126 extending around the cellar 125. In this instance, the wall 126 is metallic and extends up to the earth's surface (not shown), but may be constructed of any other material and may extend above or below the earth's surface. Further, these components may not be included in the borehole 120. The illustrated borehole 120, opening 130 and wall 126 have a circular outer shape, but instead may be rectangular (see e.g. FIG. 13) or have any other shape. Thus, the shape of the perimeter of the borehole 120, opening 130 and wall 126 are not limiting upon the present disclosure.

The borehole edge seal system 110 may have any suitable form, configuration and operation as long as it assists in providing a liquid-tight seal around the opening 130. A "liquid tight seal" around the opening 130 means assisting in preventing the passage of liquid from inside the borehole 120 through its opening 130 to the earth around and adjacent to the opening 130. The exemplary system 110 thus assists in preventing liquid inside the borehole 120 from exiting the borehole 120 through the opening 130 and contacting the area (e.g. ground) adjacent to or surrounding the opening 130. However, a "liquid-tight seal" or "sealing engagement", as referred to herein, is not necessarily always 100% liquid-tight, but may include some allowance for minimal leaking as can be expected or tolerated depending upon each particular application.

Still referring to FIG. 3, the illustrated system 110 includes a clamp 140 and a platform 150. The platform 150 assists in sealing around the opening 130, while the clamp 140 holds the platform 150 in place. The clamp 140 and platform 150 may have any suitable form, configuration and operation. In this embodiment, the clamp 140 is metallic and includes two curve-shaped clamp sections, or portions 142. At each end, each exemplary clamp section 142 includes a connection bracket 144 protruding inwardly therefrom.

The illustrated clamp sections 142 are adjustably engageable at each end at the adjacent brackets 144 with at least one connector 146, such as a bolt. When connected, the clamp sections 142 form a ring that fits within the opening 130 of the borehole 120. In other embodiments, the clamp 140 may be a single adjustable ring (not shown) or have any other suitable configuration and composition.

Still referring to FIG. 3, the illustrated platform 150 is plastic, and includes a ring-shaped collar portion 154 and a body portion 156. In this particular instance, the platform 150 includes two platform sections 158, but could instead be a single component or have any other number of platform sections 158. The exemplary platform 150 is configured to extend over the edge of the opening 130 and across the surface of the earth or other area or structure adjacent to the opening 130.

In use of the illustrated system 110, the platform 150 is placed over the borehole 120 so that its collar 154 extends into the borehole opening 130. If the platform 150 has multiple sections 158, they are appropriately positioned over the opening 130. If desired, the sections 158 may be connected or sealed together. For example, the platform sections 158 may be welded together, such as with a thermoplastic sealant material 160, at the seams, or overlaps, 164 formed therebetween to assist in providing a liquid-tight seal.

If desired, one or more seals, such as a closed-cell neoprene foam rubber seal or elastomeric seal ring, (not shown) may be sandwiched between the collar 154 of the platform 150 and the borehole wall 126. The exemplary clamp 140 is then inserted into the borehole 120 and positioned over the collar 154. The illustrated clamp 140 is tightened against the collar 154, seal(s) (if included) and borehole wall 126. In this embodiment, two sets of connectors 146, such as bolts, are inserted through the corresponding inwardly-protruding connection brackets 144 of the adjacent clamp sections 142 and tightened sufficiently to secure the system 110 to the borehole wall 126. This is an example of an "inside-clamp" arrangement, where the clamp 140 engages the inside of the borehole wall 126. As will be described below, other embodiments are referred to as "outside-clamp" arrangements, where the clamp 140 engages the outside of the borehole wall 126.

Still referring to FIG. 3, when the borehole edge seal system 110 is used in connection with a load-supporting surface 16, the body 156 of the platform 150 may be connected to adjacent mats 26 or other components. For example, the platform 150 may be sealingly engaged with adjacent mats 26. In this embodiment, the outer edges 168 of the platform 150 are welded to adjacent mats 26 using the thermoplastic sealant material 160.

Figure 4A:
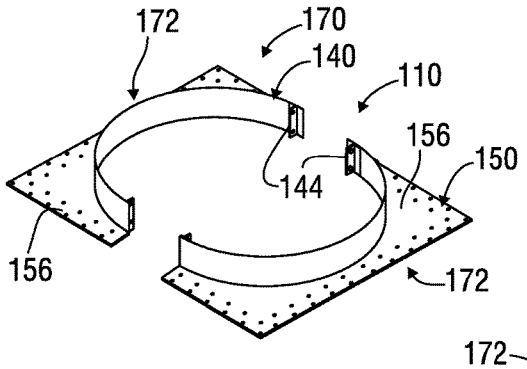
FIG. 4A is a bottom view of an embodiment of an integrally formed platform-clamp unit useful as part of an inside-clamp arrangement of a borehole edge seal system in accordance with the present disclosure.
Figure 4B:
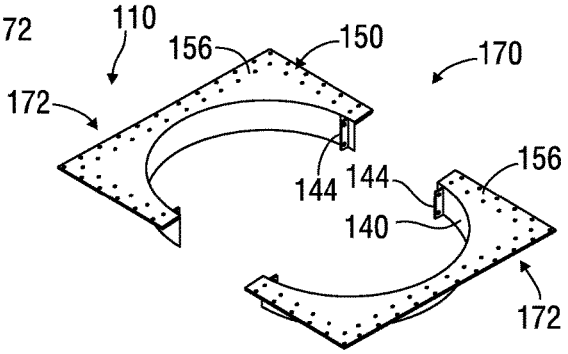
FIG. 4B is a top view of the platform-clamp unit of FIG. 4A.
Figure 7A:
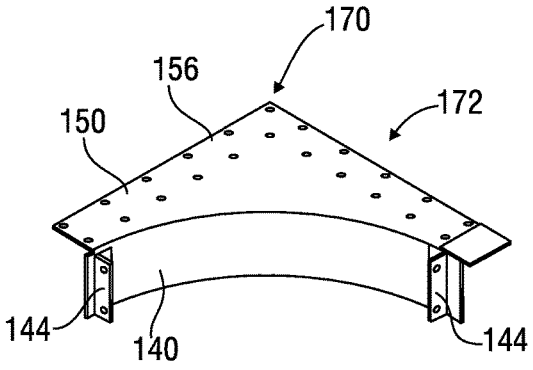
FIG. 7A is a perspective view of a quarter section of an embodiment of an integrally formed platform-clamp unit useful as part of a borehole edge seal system in an inside-clamp arrangement in accordance with the present disclosure.
Figure 7B:
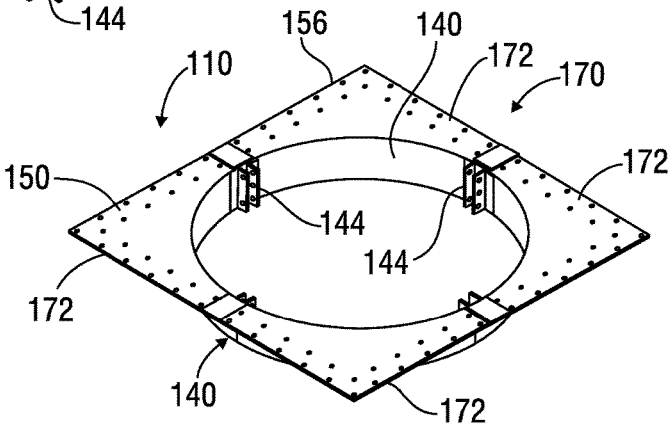
FIG. 7B is a perspective view of an embodiment of an integrally formed platform-clamp unit incorporating four of the quarter sections shown in FIG. 7A.

Now referring to FIGS. 4A & 4B, in some embodiments, the borehole edge seal system 110 may include a clamp 140 and platform 150 that are connected together, or integrally formed. For example, the clamp 140 and platform 150 may be integrally formed of metallic material, such as steel, into a unitary platform-clamp unit 170. In this embodiment, the platform 150 does not have a separate collar, and the platform-clamp unit 170 includes two sections 172 that are engageable similarly as the clamp sections 142 and platform sections 158 described with respect to FIG. 3 above. However, the platform-clamp unit 170 may instead be a single component or include any other number of sections 172. For example, the platform-clamp unit 170 of FIGS. 7A, 7B and 8 includes four similarly interconnectable sections 172.

Figure 5:
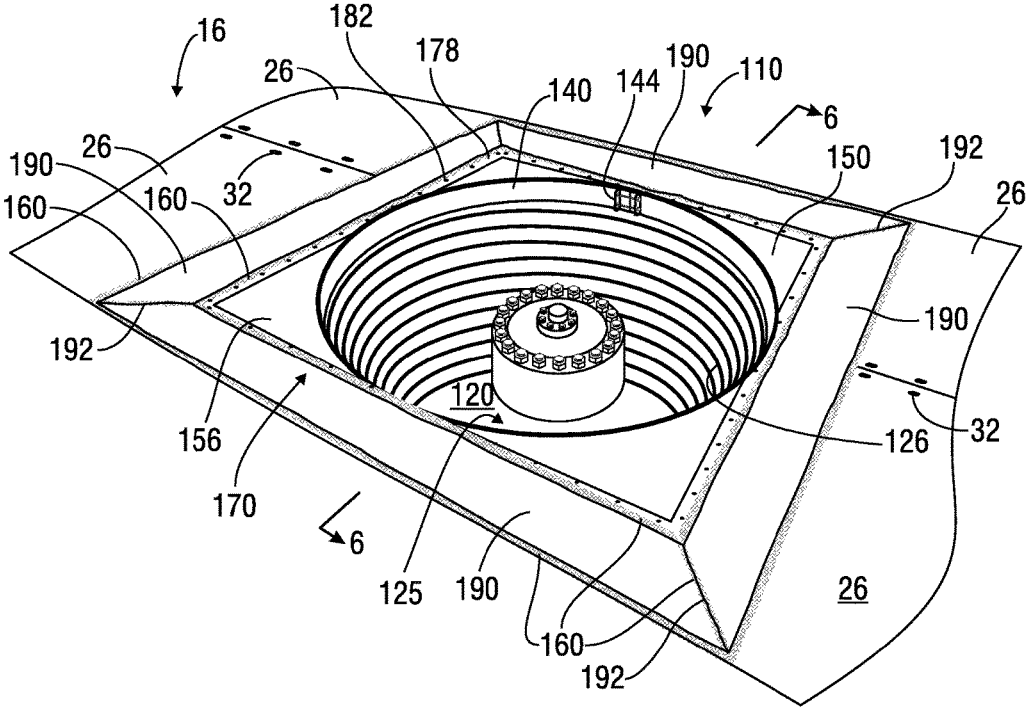
FIG. 5 is a top view of a borehole equipped with another embodiment of a borehole edge seal system having an inside-clamp arrangement in accordance with the present disclosure.
Figure 6:
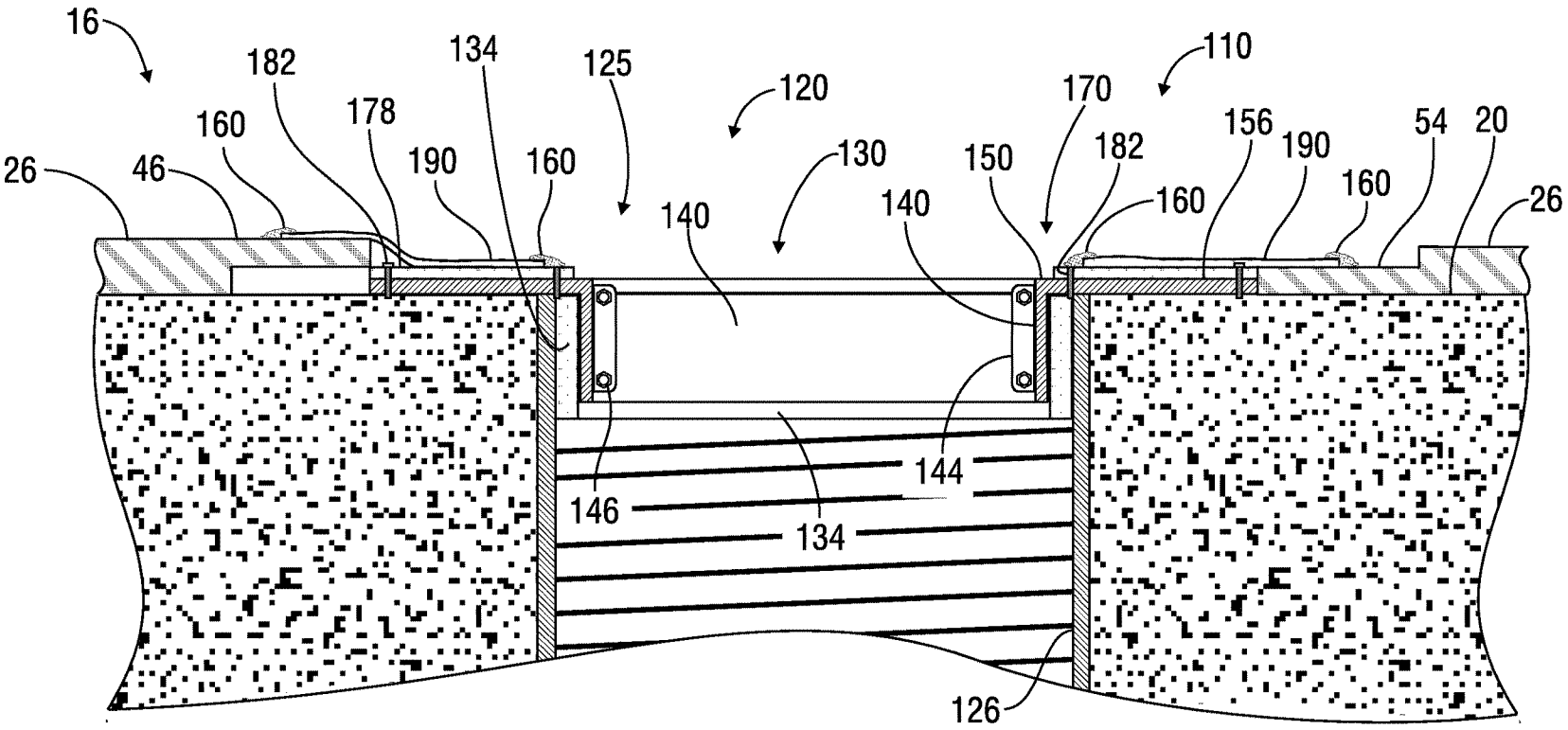
FIG. 6 is a cross-sectional view of the borehole and borehole edge seal system of FIG. 5 taken along lines 6-6.

Now referring to FIGS. 5 & 6, the borehole edge seal system 110 of FIG. 4A is shown in use with a load-supporting surface 16 around a borehole 120. Referring specifically to FIG. 6, the exemplary platform-clamp unit 170 is placed in the borehole 120 so that the clamp 140 extends around the inside of the opening 130 of the borehole 120. If desired, a seal ring 134, such as a closed-cell neoprene foam rubber or elastomeric seal, may be sandwiched between the clamp 140 and borehole wall 126 to assist in providing a liquid-tight seal. In this example, the body 156 of the platform 150 rests on the ground 20. However, there may instead be an intermediate component, ground covering or space between the platform body 156 and the ground 20.

In this particular embodiment, a frame 178 is connected to the top of the platform body 156 around the entire perimeter of the platform-clamp unit 170. The frame 178 may have any suitable form, configuration and operation. The illustrated frame 178 is plastic and connected to the platform 150 with two rows of connectors 182, such as bolts. If desired, at least one seal, such as a closed-cell neoprene foam rubber gasket (not shown), may be sandwiched between the frame 178 and platform 150. However, the frame 178, if included, may be constructed of any other suitable material and connected to the platform 150 in any other suitable manner.

Still referring to FIG. 6, the system 110 may be engaged with the adjacent mats 26 or other components of the load-supporting surface 16. In this example, plastic sheeting 190 extends from the frame 178 to the adjacent mats 26. One example of presently commercially available plastic sheeting is Site Saver Flat Sheet manufactured by Penda Corporation and distributed by HMI Materials, Inc. The plastic sheeting 190 may be sealingly engaged with the frame 178 and mats 26, such as by welding with a thermoplastic sealant material 160. If the plastic sheeting 190 has multiple sections, the seams 192 (FIG. 5) formed therebetween may also be sealed, such as with the thermoplastic sealant material 160. However, any other material(s) or component(s) may be used to sealingly engage the frame 178 to the adjacent mats 26 or other components. For example, one or more bolting strips (not shown) may extend from the frame 178 to the adjacent mats 26 and form a liquid seal therewith and therebetween, similarly as described above with respect to the plastic sheeting 190. The bolting strip may be constructed of any suitable material, such as plastic or metal, and may be engaged with the frame 178 and adjacent mats 26 in any suitable manner, such as with mechanical fasteners (e.g. bolts). One or more suitable sealants (silicone glue) or sealing materials (e.g. plastic sheeting) may be used between the bolting strip and the frame 178, mats 26, and/or over or around the mechanical fasteners.

Figure 8:
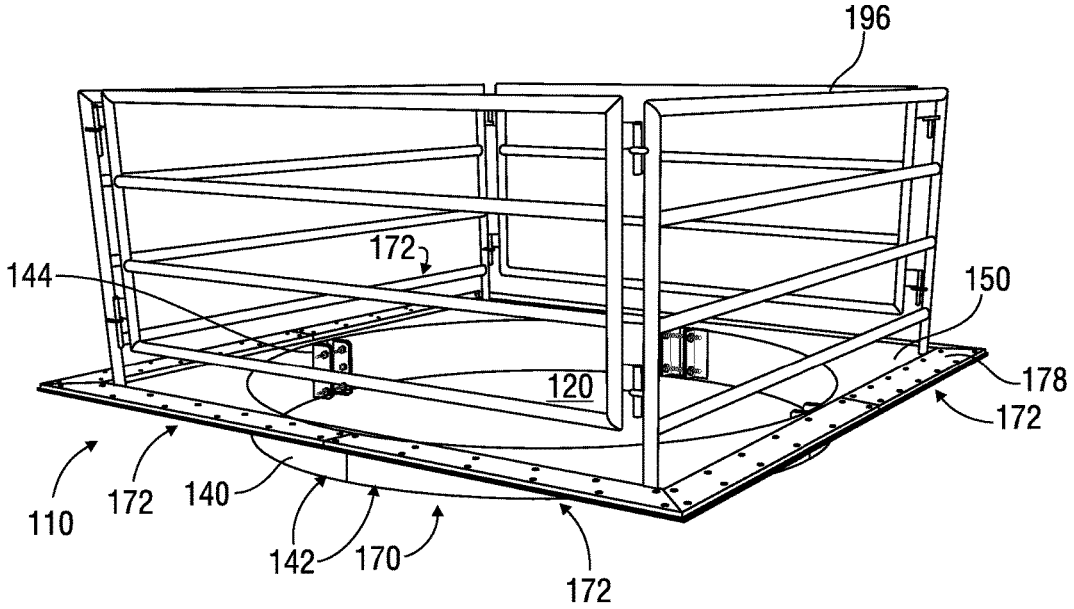
FIG. 8 is a perspective view of an embodiment of a borehole edge seal system having an inside-clamp arrangement and including an exemplary arrangement of rails in accordance with the present disclosure.
Figure 13:
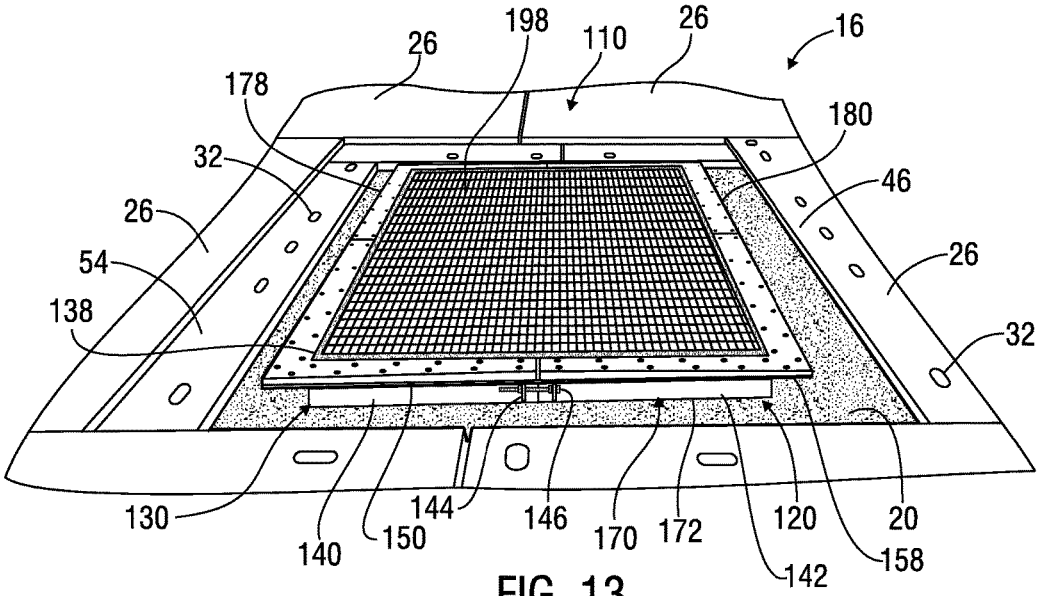
FIG. 13 is a perspective partial view of a borehole equipped with an embodiment of a borehole edge seal system used in an outside-clamp arrangement with a rectangular-shaped borehole in accordance with the present disclosure.

Referring to FIG. 8, if desired, an arrangement of rails 196 may be provided around the borehole edge seal system 110 and borehole 120, such as to limit access thereto and/or for safety. As shown in FIG. 13, a metal grating 198 may be also or instead be emplaced over the borehole 120, such as to limit access thereto and/or for safety. However, the present disclosure does not require either of these features.

Figure 9:
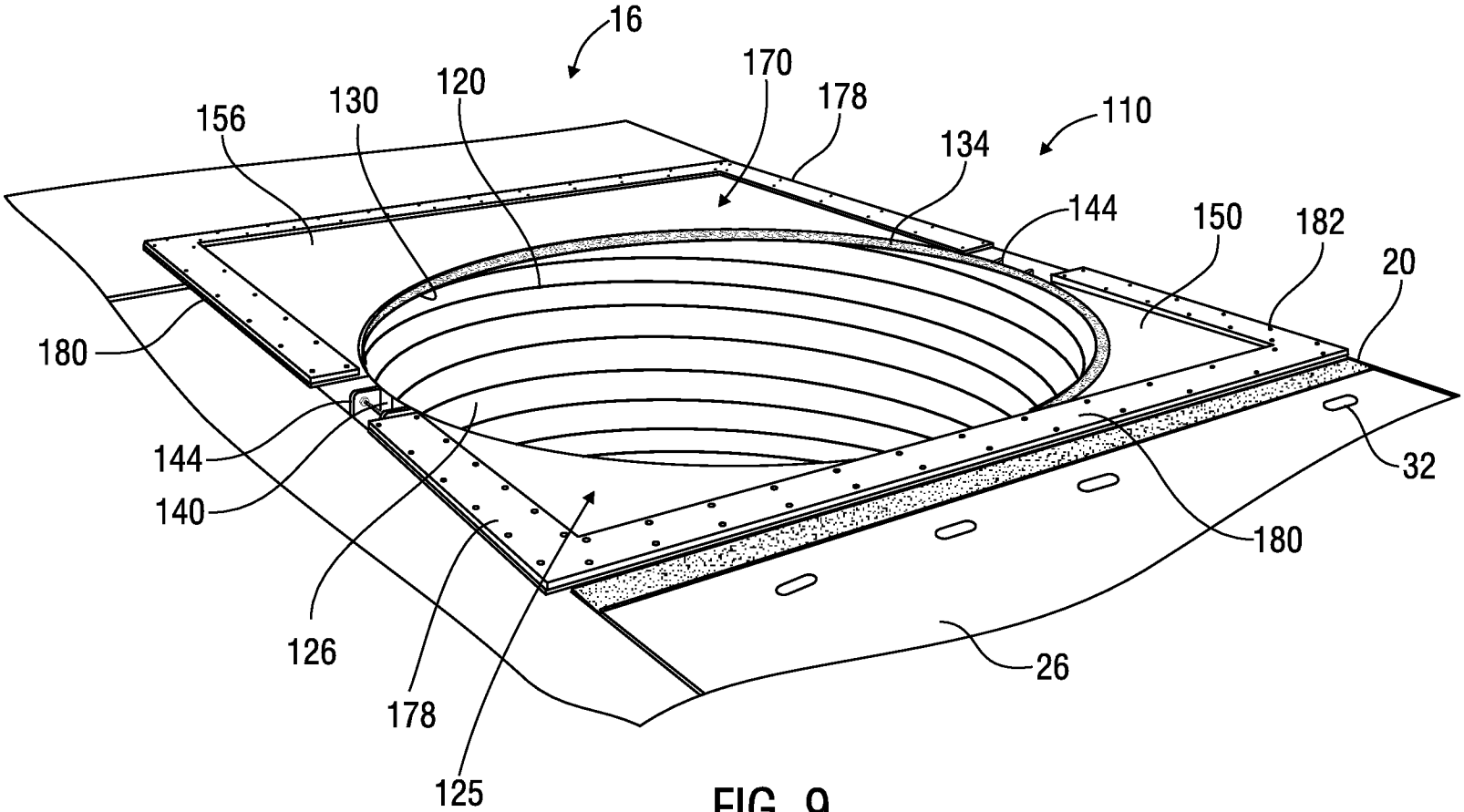
FIG. 9 is a perspective view of a borehole equipped with an embodiment of a borehole edge seal system having an outside-clamp arrangement in accordance with the present disclosure.
Figure 10:
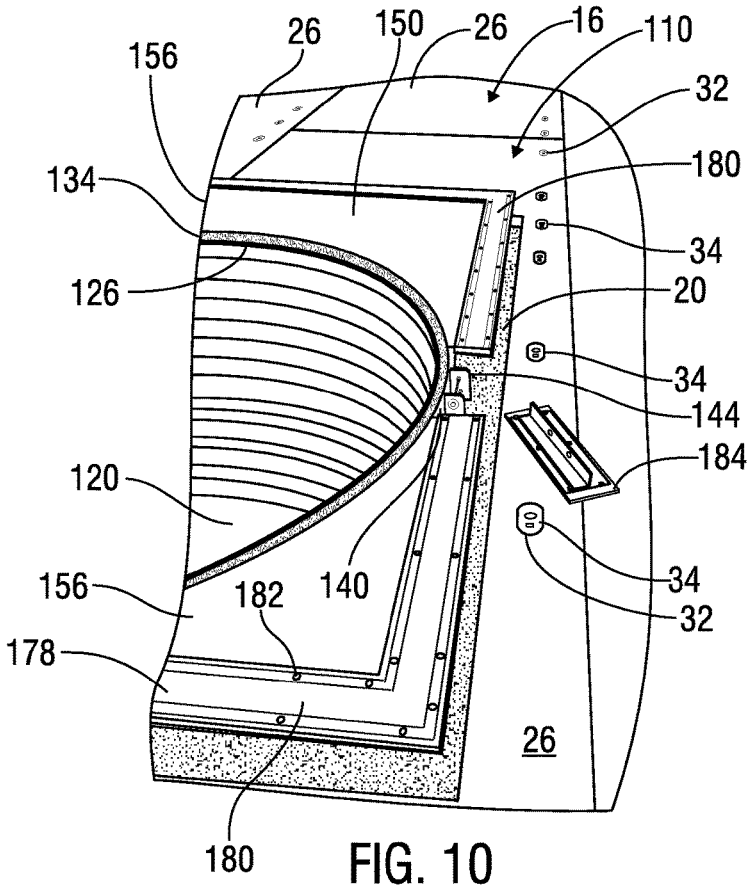
FIG. 10 is a perspective view of a borehole equipped with an embodiment of a borehole edge seal system having an outside-clamp arrangement in accordance with the present disclosure.
Figure 12:
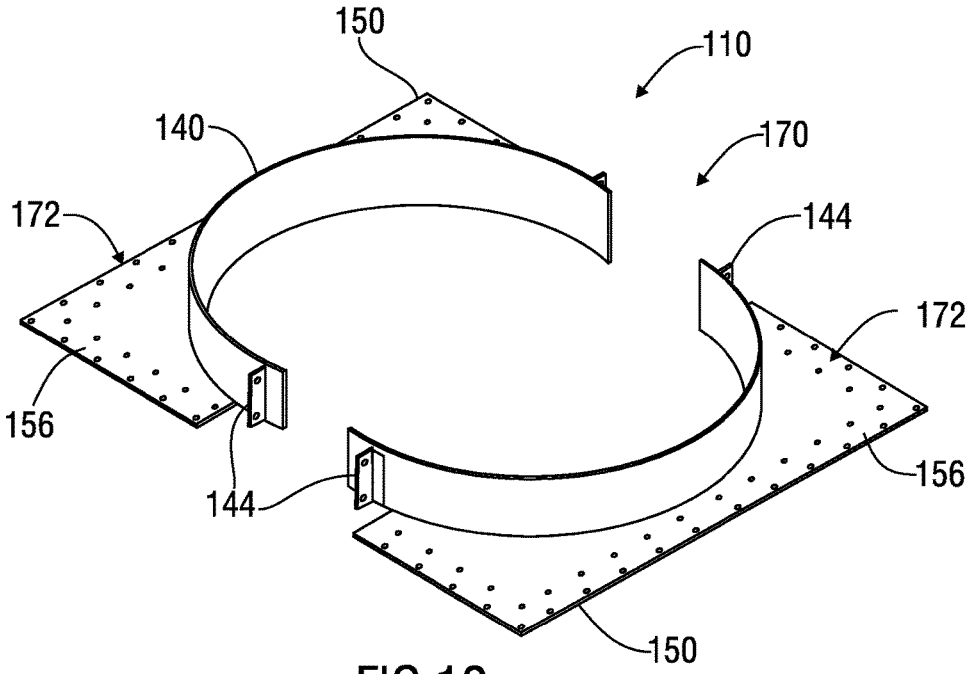
FIG. 12 is a perspective view of an embodiment of an integrally formed platform-clamp unit useful as part of a borehole edge seal system in an outside-clamp arrangement in accordance with the present disclosure.
Figure 11:
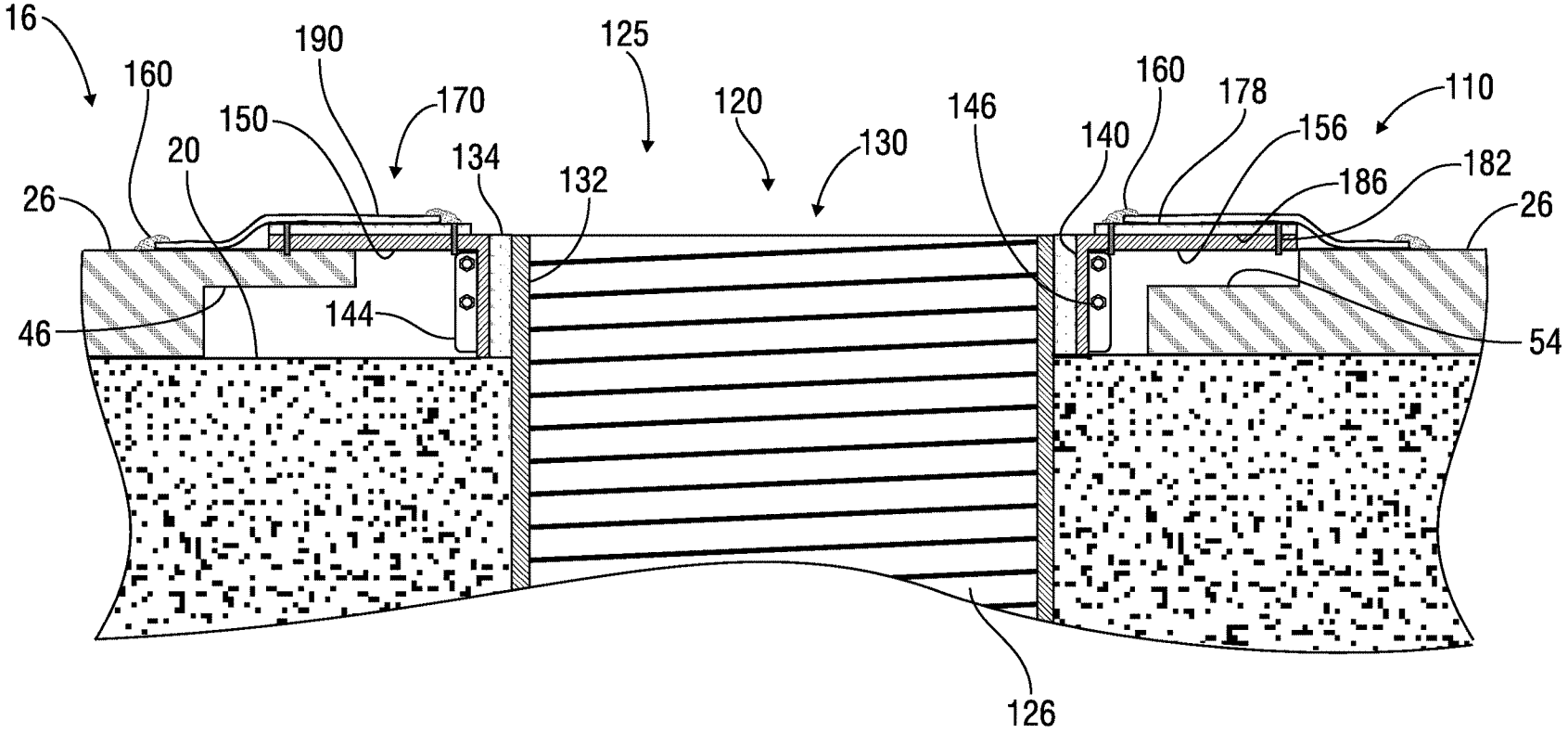
FIG. 11 is a cross-sectional view of a borehole equipped with an embodiment of a borehole edge seal system having an outside-clamp arrangement in accordance with the present disclosure.

Now referring to FIGS. 9-11, an embodiment of the borehole edge seal system 110 is shown used with a borehole 120 having a wall 126 that extends above the ground 20. The illustrated clamp 140 and platform 150 are integrally formed of metallic material, such as steel, into a unitary platform-clamp unit 170. In this embodiment, the platform-clamp unit 170 includes two sections 172 (FIG. 12) that are engageable similarly as the clamp sections 142 and platform portions, or sections, 158 described with respect to FIG. 3 above. However, in this embodiment, the connection brackets 144 of the clamp 140 are on the outside of the clamp 140 so the clamp 140 can be tightened around the outside of the borehole wall 126. This is an example of an "outside-clamp" arrangement, where the clamp 140 engages the outside of the borehole wall 126. As in the other embodiments, the platform-clamp unit 170 may instead be a single component or include any other number of sections 172.

Referring specifically to FIG. 11, the exemplary platform-clamp unit 170 is placed around the upwardly protruding portion 132 of the borehole wall 126 so that the clamp 140 extends around the outside of the opening 130. If desired, at least one seal, such as a closed-cell neoprene foam rubber or elastomeric seal ring 134, may be sandwiched between the clamp 140 and borehole wall 126 to assist in providing a liquid-tight seal. In this example, the body 156 of the platform 150 is shown spaced upwardly off of the ground 20. However, there may instead be an intermediated component or ground covering between the platform body 156 and the ground 20.

Still referring to FIG. 11, in this embodiment, a frame 178 is connected to the top of the platform body 156 around the entire perimeter of the platform-clamp unit 170. The frame 178 may have any suitable form, configuration and operation. The illustrated frame 178 is plastic and connected to the platform 150 with two rows of connectors 182, such as bolts. In this example, the frame 178 has two frame sections 180 (e.g. FIG. 9) and a pair of removable bracket covers 184 (e.g. FIG. 10) positionable therebetween. The illustrated bracket covers 184 allow access to the connection brackets 144 of the clamp 140. If desired, at least one seal, such as a closed-cell neoprene foam rubber gasket 186 may be sandwiched between the frame 178 and platform 150. However, the frame 178, if included, may be constructed of any other suitable material and connected to the platform 150 in any other suitable manner.

Still referring to FIG. 11, the illustrated system 110 may be engaged with the adjacent mats 26 or other components of the load-supporting surface 16. In this example, plastic sheeting 190 extends from the frame 178 to the adjacent mats 26. The plastic sheeting 190 may, if desired, be sealingly engaged with the frame 178 and mats 26, such as by welding with a thermoplastic sealant material 160. If the plastic sheeting 190 has multiple sections, the seams (not shown) formed therebetween may also be sealed, such as with the thermoplastic sealant material 160. However, any other material(s) or component(s) may be used to sealingly engage the frame 178 to the adjacent mats 26 or other components.

Figure 14:
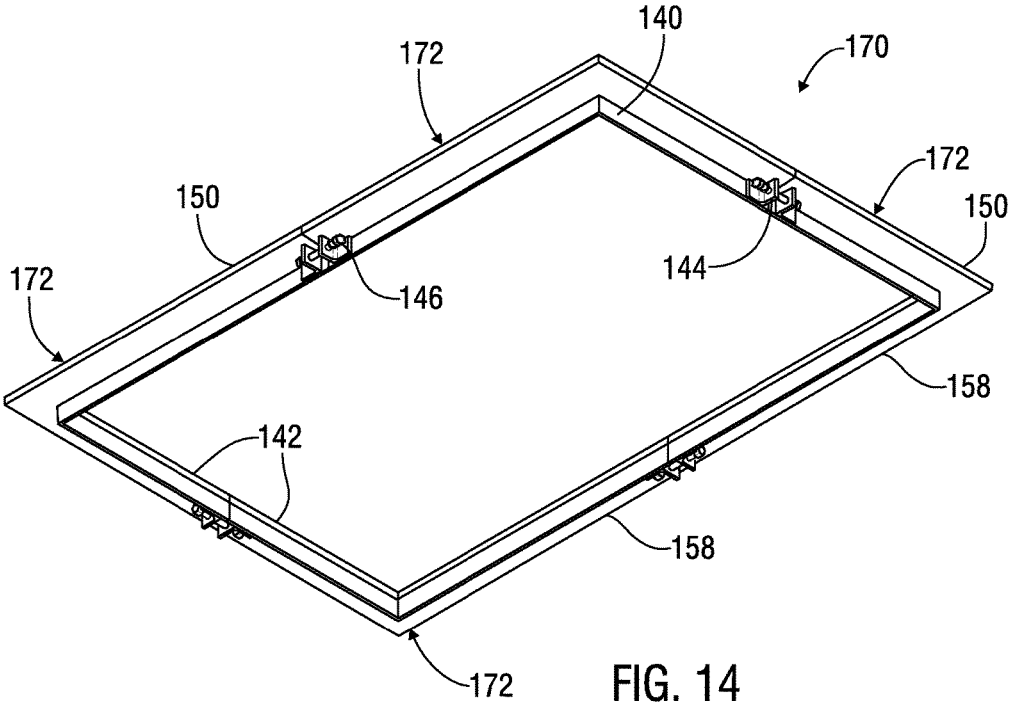
FIG. 14 is a perspective view of an embodiment of a rectangular shaped platform-clamp unit useful in the exemplary borehole edge seal system shown in FIG. 13.

Now referring to FIGS. 13 & 14, an embodiment of the borehole edge seal system 110 useful with a rectangular shaped borehole 120 is shown. The exemplary borehole 120 has a wall (not shown) that extends above the ground 20. The illustrated clamp 140 and platform 150 are integrally formed of metallic material, such as steel, into a unitary platform-clamp unit 170. In this embodiment, the platform-clamp unit 170 includes four sections 172 that are engageable similarly as the sections 172 described with respect to FIGS. 9-11 above. As shown the illustrated connection brackets 144 of the clamp 140 are on the outside of the clamp 140 so the clamp 140 can be tightened around the outside of the borehole wall (not shown). As in the other embodiments, the platform-clamp unit 170 may instead be a single component or include any other number of sections 172.

In this embodiment, one or more seals (not shown) may be placed between the clamp 130 and the borehole wall (not shown). The seal may have any suitable form, configuration and operation. In this example, the seal is a band of a closed-cell neoprene foam rubber extended around the perimeter of the rectangular borehole wall (not shown). As mentioned above, this embodiment also includes an optional metal grating 198 emplaced over the borehole 120, such as to limit access thereto and/or for safety. Otherwise, the features, assembly and operation of the platform-clamp unit 170 of this embodiment are similar to the embodiment of FIGS. 9-12.

In accordance with all of the above embodiments of the present disclosure, if the borehole 120 overflows with liquid(s) and/or solids, the borehole edge seal system 110 and related components will assist in preventing such liquid(s) and/or solids from at least substantially contacting or contaminating the earth (or other surface or area) adjacent to the borehole 120. Further, in at least some embodiments, this may be accomplished without the need for any liners below or adjacent to the system 110 and/or load-supporting surface 16. It should be noted that, in all of the above embodiments, one or more sealants may be used at any intersection of components and/or one or more seals placed between components, such as to assist in providing a liquid-tight seal around the opening 130 to the borehole 120. Any suitable sealant, such as silicone glue, may be used.

If desired, the borehole edge seal system 110 may be part of a spill management system to prevent liquid leakage from one or more permanent, semi-permanent or temporary load-supporting surfaces 16 and facilitate clean-up or disposal of such liquid. For example, the system 110 may be used in conjunction with technology shown and disclosed in any combination of U.S. Pat. Nos. 5,653,551 and 6,511,257, and U.S. patent application Ser. Nos. 13/780,350 and 13/790,916, such as to provide a self-contained liquid barrier system around and across the load-supporting surface 16 without the need for any liners below or adjacent to the load-supporting surface 16.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of any appended claims, and may be made and used by one of ordinary skill in the art without departing from the spirit or teachings of the invention and scope of this disclosure and any appended claims. Thus, all matter herein set forth or shown in the accompanying drawings should be interpreted as illustrative, and the scope of the disclosure and any appended claims should not be limited to the embodiments described and shown herein.

The invention claimed is:

1. Apparatus useful for providing a liquid-tight seal around a cellar formed around a hydrocarbon exploration or production well and extending into the earth from the earth's surface, the cellar having an opening and a wall extending around itself downwardly below the earth's surface and not above the earth's surface, the cellar wall having a top edge, the apparatus comprising:

a clamp configured to be positioned inside the cellar proximate to the opening thereof and firmly engage the inside of the cellar wall, said clamp comprising at least first and second interconnectable sections, each said clamp section having at least one inwardly projecting connection bracket associated therewith, respectively, each said connection bracket of each said clamp section being releasably engageable with one of said connection brackets of another said clamp section to connect said clamp sections together;

at least one platform configured to extend outwardly from the top of said clamp relative to the cellar, over the top edge of the cellar wall and across the earth's surface adjacent to and around the cellar when said clamp is engaged with the cellar wall, wherein said platform is configured to sealingly engage at least one adjacent mat of a reusable load-supporting surface, said load-supporting surface having at least two said mats;

at least one frame configured to sealingly engage and extend at least partially between said platform and at least one of said adjacent mats, said frame being releasably coupled to said platform; and at least one seal member configured to be disposed between the cellar wall and at least one among said clamp and said platform to form a liquid-tight seal therebetween, wherein liquid exiting the cellar through the cellar opening is prevented from contacting the earth around the cellar opening.

2. The apparatus of claim 1 wherein said frame includes at least first and second frame sections.

3. The apparatus of claim 1 wherein said frame is constructed at least partially of plastic and coupled to said platform with mechanical connectors.

4. The apparatus of claim 3 further including at least one sealing gasket sandwiched between said frame and said platform.

5. The apparatus of claim 1 further including at least one plastic sheet extending at least partially between said frame and at least one adjacent said mat, said plastic sheet being sealingly engaged with said frame and said at least one adjacent mat to form a liquid-tight seal therebetween.

6. The apparatus of claim 5 wherein said at least one plastic sheet is configured to be welded to at least one said adjacent mat with thermoplastic sealant material.

7. The apparatus of claim 1 wherein said clamp and said platform are unitary.

8. The apparatus of claim 1 wherein the cellar has a circular shape, further wherein said clamp has a circular shape and said interconnectable sections are curved-shaped.

9. The apparatus of claim 1 wherein liners are absent from beneath said platform and said load-supporting surface, wherein liquid disposed on said load-supporting surface and liquid exiting the cellar through the cellar opening are prevented from contacting the earth around the cellar opening without the use of underlying liners.

10. The apparatus of claim 1 wherein the cellar has a rectangular shape, further wherein said clamp has a rectangular shape.

11. Apparatus useful for providing a liquid-tight seal between a cellar formed around a hydrocarbon exploration or production well and extending into the earth from the earth's surface and at least one adjacent mat of a load-supporting surface, the cellar having an opening and a wall extending around itself, downwardly below the earth's surface and not above the earth's surface, the cellar wall having a top edge, the apparatus comprising:

a clamp configured to be positioned inside the cellar proximate to the opening thereof and firmly engage the inside of the cellar wall, said clamp comprising at least first and second interconnectable sections, each said clamp section having at least one inwardly projecting connection bracket associated therewith, each said connection bracket of each said clamp section being releasably engageable with one of said connection brackets of another said clamp section to connect said clamp sections together;

at least one platform configured to extend outwardly from the top of said clamp relative to the cellar, over the top edge of the cellar wall and across the earth's surface adjacent to and around the cellar when said clamp is engaged with the cellar wall, wherein said platform and said clamp are non-unitary, said platform including a collar portion and a body portion, said collar portion configured to be positioned and sandwiched between said clamp and the cellar wall and said body portion extending outwardly therefrom over the top edge of the cellar wall and across the earth's surface adjacent to the cellar;

at least one frame configured to sealingly engage and extend at least partially between said platform and at least one adjacent mat, said frame being releasably coupled to said platform; and at least one seal member configured to be disposed between the cellar wall and at least one among said clamp and said platform to form a liquid-tight seal therebetween, wherein liquid exiting the cellar through the cellar opening is prevented from contacting the earth around the cellar opening.

12. The apparatus of claim 11 wherein said frame is constructed at least partially of plastic and coupled to said platform with mechanical connectors.

13. The apparatus of claim 11 wherein the cellar has a circular shape, further wherein said clamp has a circular shape and includes multiple curved-shaped said interconnectable sections.

14. Apparatus useful for providing a liquid-tight seal around between a cellar formed around a hydrocarbon exploration or production well and extending into the earth from the earth's surface and at least one adjacent mat of a load-supporting surface, the cellar having an opening and a wall extending around itself, downwardly below the earth's surface and not above the earth's surface, the cellar wall having a top edge, the apparatus comprising:

a clamp configured to be positioned inside the cellar proximate to the opening thereof and firmly engage the inside of the cellar wall, said clamp having a rectangular shape and comprising at least first and second interconnectable sections, each said clamp section having at least one inwardly projecting connection bracket associated therewith, each said connection bracket of each said clamp section being releasably engageable with one of said connection brackets of another said clamp section to connect said clamp sections together;

at least one platform configured to extend outwardly from the top of said clamp relative to the cellar, over the top edge of the cellar wall and across the earth's surface adjacent to and around the cellar when said clamp is engaged with the cellar wall;

at least one frame configured to sealingly engage and extend at least partially between said platform and at least one adjacent mat, said frame being releasably coupled to said platform; and at least one seal member configured to be disposed between the cellar wall and at least one among said clamp and said platform to form a liquid-tight seal therebetween, wherein liquid exiting the cellar through the cellar opening is prevented from contacting the earth around the cellar opening.

15. The apparatus of claim 14 wherein said clamp and said platform are unitary.

16. The apparatus of claim 14 further including a horizontally-oriented metal grate extending over the cellar to limit access thereto.

17. Apparatus useful for providing a liquid-tight seal between a cellar formed around a hydrocarbon exploration or production well and extending into the earth from the earth's surface and at least one adjacent mat of a load-supporting surface, the cellar having an opening and a wall extending around itself, downwardly below the earth's surface and not above the earth's surface, the cellar wall having a top edge, the apparatus comprising:

a clamp configured to be positioned inside the cellar proximate to the opening thereof and firmly engage the inside of the cellar bared wall, said clamp comprising at least first and second interconnectable sections, each said clamp section having at least one inwardly projecting connection bracket associated therewith, respectively, each said connection bracket of each said clamp section being releasably engageable with one of said connection brackets of another said clamp section to connect said clamp sections together;

at least one platform configured to extend outwardly from the top of said clamp relative to the cellar, over the top edge of the cellar wall and across the earth's surface adjacent to and around the cellar when said clamp is engaged with the cellar wall;

at least one seal member configured to be disposed between the cellar wall and at least one among said clamp and said platform to form a liquid-tight seal therebetween, wherein liquid exiting the cellar through the cellar opening is prevented from contacting the earth around the cellar opening;

at least one frame configured to sealingly engage and extend at least partially between said platform and at least one adjacent mat, said frame being releasably coupled to said platform; and an arrangement of vertically extending rails extending around the cellar to limit access thereto.

18. The apparatus of claim 17 further including at least one plastic sheet extending at least partially between said frame and at least one adjacent mat, said plastic sheet being sealingly engaged with said frame and at least one adjacent mat to form a liquid-tight seal therebetween.

19. The apparatus of claim 17 wherein said clamp and said platform are unitary.

20. A liquid containment system useful around a cellar formed around a hydrocarbon exploration or production well and extending into the earth from the earth's surface, the cellar having an opening and a wall extending around itself, the system comprising:

a reusable load-supporting surface deployed on or near the earth's surface proximate to the cellar, said load-supporting surface having at least two mats;

at least one clamp configured to sealingly engage the cellar wall around the cellar proximate to the opening thereof;

at least one platform configured to extend outwardly from said clamp relative to the cellar and over the earth's surface adjacent to the cellar;

at least one frame configured to sealingly engage and extend at least partially between said platform and at least one said adjacent mat of said load-supporting surface; and at least one seal member configured to be disposed between the cellar wall and at least one among said clamp and said platform to form a liquid-tight seal therebetween, wherein liquid disposed on the load-supporting surface and liquid exiting the cellar through the cellar opening are prevented from contacting the earth around the cellar reopening.

21. The system of claim 20 wherein the cellar has a circular shape, further wherein said clamp is a single unitary ring.

22. The system of claim 20 wherein liners are absent from beneath said platform and said load-supporting surface, wherein liquid disposed on said load-supporting surface and liquid exiting the cellar through the cellar opening are prevented from contacting the earth around the cellar opening without the use of underlying liners.

23. The system of claim 20 wherein said platform and said clamp are non-unitary.

24. The system of claim 20 further including at least one plastic sheet extending at least partially between said frame and at least one adjacent said mat, said plastic sheet being sealingly engaged with said frame and said at least one adjacent mat to form a liquid-tight seal therebetween.

25. The system of claim 20 wherein said clamp and said platform are unitary.

26. The system of claim 20 wherein the cellar wall has a top edge and said platform and said clamp are non-unitary, said platform including a collar portion and a body portion, said collar portion being configured to be positioned and sandwiched between said clamp and the cellar wall and said body portion extending outwardly therefrom over the top edge of the cellar wall and across the earth's surface adjacent to the cellar.

27. The system of claim 20 wherein said clamp has a circular or rectangular shape.

28. The system of claim 20 wherein the cellar wall extends downwardly below the earth's surface and not above the earth's surface, said at least one clamp being positionable inside the cellar and configured to firmly engage the inside of the cellar.

29. The system of claim 20 wherein the cellar wall extends upwardly above and downwardly below the earth's surface, at least one said clamp being positionable around cellar wall above the earth's surface proximate to the opening of the cellar, said at least one clamp configured to firmly engage the outside of the cellar.

30. The system of claim 29 further including a horizontally-oriented metal grate extending over the cellar to limit access thereto.

31. Method of providing a liquid-tight seal between a cellar formed around a hydrocarbon exploration or production well extending into the earth from the earth's surface and a reusable load-supporting surface deployed on or near the earth's surface proximate to the cellar, the load-supporting surface having at least two mats, the cellar having a wall extending around its opening, the method comprising:

sealingly engaging at least one clamp with the cellar wall around the perimeter of the cellar proximate to the opening thereof;

extending at least one platform outwardly from the clamp relative to the cellar around the perimeter of the cellar and over the earth's surface adjacent to the cellar; and sealingly engaging at least one frame to the platform and at least one adjacent mat of the load-supporting surface around the entire perimeter of the cellar, wherein liquid disposed on the load-supporting surface and liquid exiting the cellar through the cellar opening are prevented from contacting the earth around the cellar-opening.

* * * * *